United States Patent [19]

Pelski

[11] Patent Number: 4,888,838

[45] Date of Patent: Dec. 26, 1989

[54] MATTRESS SUPPORT

[76] Inventor: Ronald E. Pelski, 30 Chestnut St., Ware, Mass. 01082

[21] Appl. No.: 223,620

[22] Filed: Jul. 25, 1988

[51] Int. Cl.[4] ..... A47C 15/00

[52] U.S. Cl. ..... 5/207; 5/308; 5/400

[58] Field of Search ..... 5/193, 207, 308, 400, 5/401, 411, 200 R, 201

[56] References Cited

U.S. PATENT DOCUMENTS

| | | | |
|---|---|---|---|
| 3,537,114 | 11/1970 | Mis | 5/201 |
| 3,555,579 | 1/1971 | Harris | 5/201 X |
| 3,869,738 | 3/1975 | Lawrence | 5/200 R |
| 4,186,452 | 2/1980 | Underwood | 5/400 X |
| 4,597,117 | 7/1966 | Sumner | 5/308 X |
| 4,613,999 | 9/1986 | Franco et al. | 5/400 |

*Primary Examiner*—Michael F. Trettel
*Attorney, Agent, or Firm*—Charles R. Fay

[57] ABSTRACT

A waterbed support comprising a box-like frame including vertical spaced end walls and side walls secured at their respective ends and forming a continuous rectangular frame open at top and bottom, a plurality of solid parallel spaced partitions similar to the end walls and individually connecting the side walls and forming a plurality of drawer compartments in the open frame, and brackets for positioning and supporting the waterbed, there being one bracket secured on each partition and end wall, each bracket having a flat section secured on top of a partition or end wall and extending outwardly of the frame, overlapping the same, an upwardly directed stop at the outboard end of each section, and a downwardly directed stop on each section between the ends thereof so that the two stops on each bracket are spaced apart, the downwardly directed stops abutting the adjacent side wall of the frame and the upwardly directed stops of the brackets being aligned in a row outwardly of the side wall.

3 Claims, 1 Drawing Sheet

MATTRESS SUPPORT

FIELD OF THE INVENTION

Floor supported mattress support including storage drawers that are partitioned, with brackets on the partitions to locate and position the mattress.

BACKGROUND OF THE INVENTION

There are many floor supported mattress supports and the waterbed has greatly increased the use of these mattress supports. Usually such mattress supports, and especially the supports for waterbeds, are essentially and merely open top and bottom frames that may be provided with special brackets to constrain the waterbed or other mattress to a selected location. This invention goes beyond such a structure and takes advantage of the frame to provide slidable drawers between added partitions in the frame, thereby adding utility and strength to the original open empty frame.

SUMMARY OF THE DISCLOSURE

Although the basic bottom frame may be plain and simple, this invention contemplates the use of more complicated frames as well, that is, e.g., a pair of similar open frames that can be placed together for a double-size bed, or spaced to a certain extent to provide queen or king size frames for like size mattresses or waterbeds. Each such open frame comprises front and rear longitudinal parallel stringers set on edge so they are vertical with interconnected end members and spaced parallel partitions along the stringers. These partitions and end members form compartments that accommodate slidable drawers for storage of e.g. bed clothing.

Brackets are secured to each partition and a stringer and extend outboard of the stringer to locate and help support any mattress support, but more especially waterbeds. Drawer supports and guides can be utilized and two of the above described frames can be set together, in back to back relation, to make a support for a double bed, etc. Through the use of the partitions, the extra strength for waterbeds is provided and advantage is taken of the partitions to support the brackets, so that no specially provided elements are needed to carry the brackets.

PREFERRED EMBODIMENT OF THE INVENTION

Figure 1:
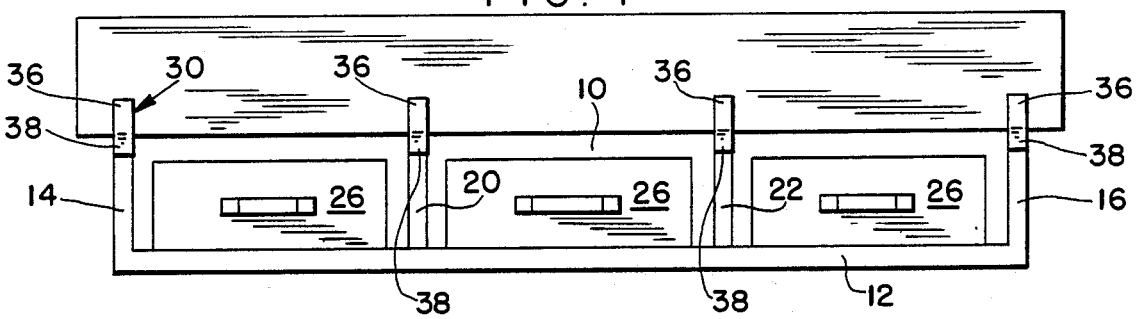
FIG. 1 is a front elevational view showing the drawers, frame, brackets, and waterbed.

The frame in this case comprises a front panel including longitudinal upper strip 10 and spaced parallel lower strip 12, end members 14 and 16, rear wall 18, and partitions 20 and 22. Various struts and braces 23 may be used if desired, and the end members and partitions may be hidden at their ends by short strips that blend in with the longitudinal strips 10 and 12. The rear wall 18 and the partitions 20, 22, may be made of material inferior to strip 10 and 12, but the partitions, and end walls 14 and 16, are made of a sturdy material that acts to anchor fastenings 24, as will be described. While the rear wall 18 may be solid, the front wall is built up to provide openings through which drawers 26 are slid in and out on typical guides 28.

Figure 3:
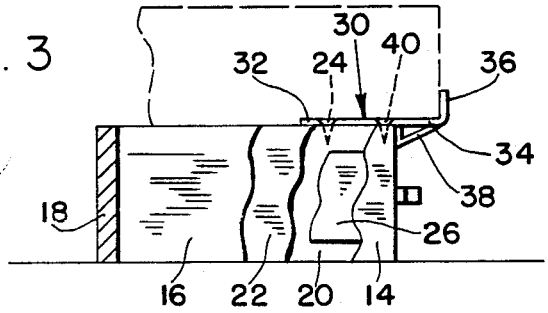
FIG. 3 is an end view of a single frame, parts broken away, looking in the direction of arrow 3 in FIG. 2.

The mattress or waterbed brackets 30 are all alike and comprise a main plate 32 extending rearwardly over the respective partitions and outboard of the front wall as at 34, with an upstanding stop 36 at the end, and a downwardly extending stop 38 abutting the front wall, FIG. 3, to locate the brackets on the partitions, while the mattress support is located by the stop 36. The fasteners 24, e.g. wood screws or the like, secure each bracket onto a partition or end wall, and extra fasteners 40, 40, are used to additionally fix the brackets to the partitions or to wood strips that cover the partition ends or the strip 10 itself, depending on the specific structure of the front wall.

Figure 2:
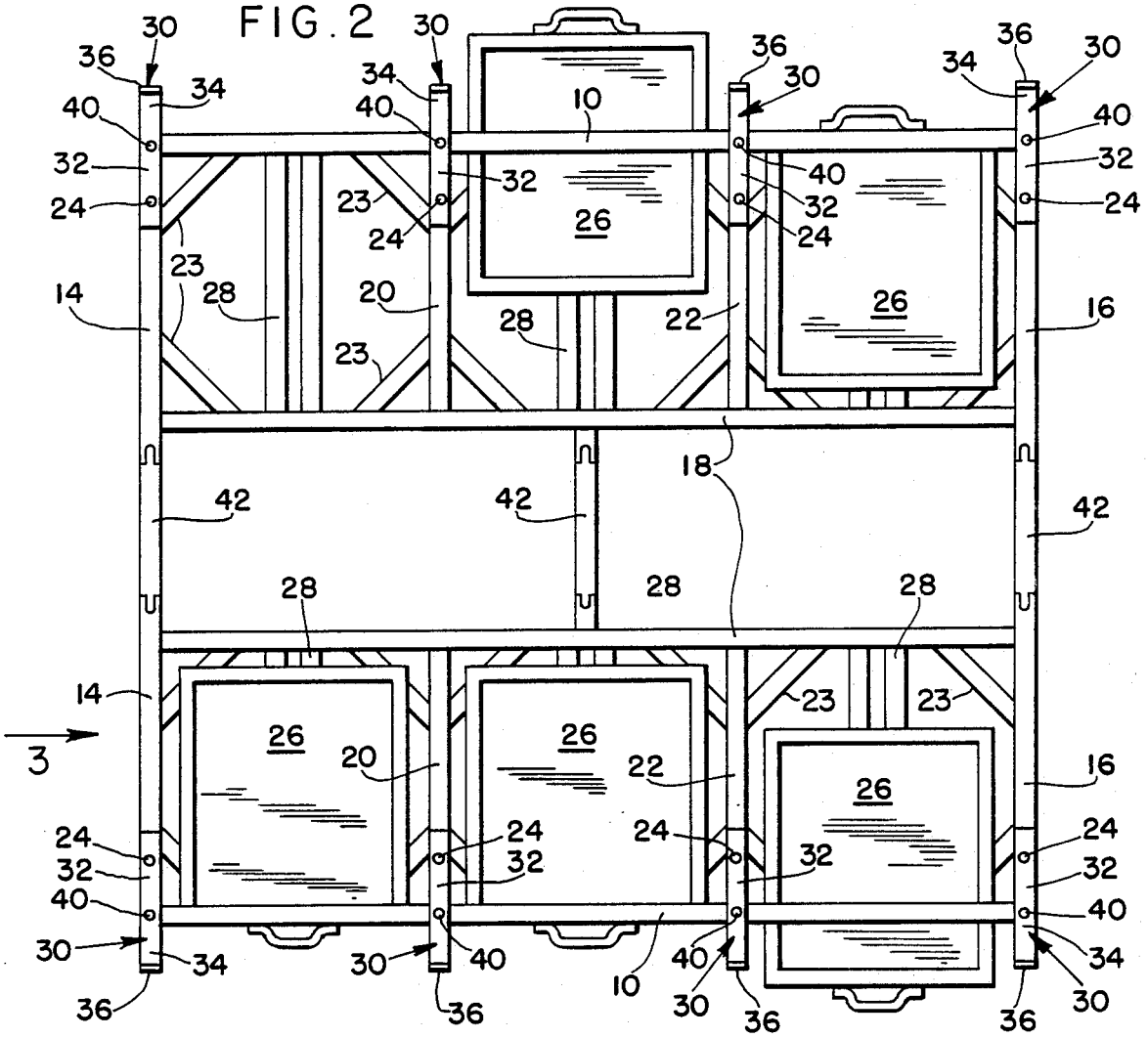
FIG. 2 is a plan view of a form of the invention without any mattress and showing how the invention may be applied to a large size bed.

In FIG. 2, two of the frame units are placed back to back and connectors 42 of desired width are used to make up a queen, of king size bed, but the opposed stops 36 are spaced for the desired size of mattress and prevent misplacement of the mattress. All the partitions serve to help support the mattress and as supports for brackets 30, which otherwise would have to have special supports provided.

I claim:

1. A bedstead comprising a box-like frame including vertical spaced end walls and side walls secured at their respective ends and forming a continuous rectangular frame open at top and bottom, a plurality of solid parallel spaced partitions similar to the end walls and individually connecting the side walls and forming a plurality of drawer compartments in the open frame, said partitions, end walls and side walls having top surfaces, and a mattress or mattress support bracket on each partition and end wall, said brackets being aligned along a side wall of the frame, each bracket comprising a flat section positioned flatly on and secured to the top surface of a partition or end wall, said sections being significantly shorter than any partition or end wall and extending outwardly of the frame, overhanging the same, a stop at the outboard end of the section, said stops being directed upwardly in a row, and a downwardly directed stop on each bracket section, the downwardly directed stops being located between the ends of the sections so that the two stops on each bracket are spaced apart, the downwardly directed stops abutting the adjacent side wall of the frame.

2. The bedstead of claim 1 including a fastener for fastening each bracket to its corresponding partition or end wall.

3. The bedstead of claim 2 including a second fastener for fastening each bracket and a corresponding side wall.

* * * * *